US011348464B1

(12) United States Patent
Liao

(10) Patent No.: US 11,348,464 B1
(45) Date of Patent: May 31, 2022

(54) SYSTEM AND METHOD FOR DISPATCH CONTROL FOR AUTONOMOUS DRIVING ENGINEERING

(71) Applicant: Ecotron LLC, Whittier, CA (US)

(72) Inventor: Matt Liao, Whittier, CA (US)

(73) Assignee: ECOTRON LLC, Whittier, CA (US)

( * ) Notice: Subject to any disclaimer, the term of this patent is extended or adjusted under 35 U.S.C. 154(b) by 0 days.

(21) Appl. No.: 17/573,518

(22) Filed: Jan. 11, 2022

(51) Int. Cl.

| | |
|---|---|
| ***G08G 1/16*** | (2006.01) |
| ***E02F 9/20*** | (2006.01) |
| ***G08G 1/00*** | (2006.01) |

(52) U.S. Cl.
CPC ..... *G08G 1/164* (2013.01); *E02F 9/205* (2013.01); *E02F 9/2045* (2013.01); *E02F 9/2054* (2013.01); *G08G 1/166* (2013.01); *G08G 1/20* (2013.01)

(58) Field of Classification Search
CPC ..... G08G 1/164; G08G 1/166; G08G 1/20; E02F 9/2045; E02F 9/205; E02F 9/2054
See application file for complete search history.

(56) References Cited

U.S. PATENT DOCUMENTS 7,729,857 B2 6/2010 Mudalige et al.
8,346,468 B2 * 1/2013 Emanuel ..... B66F 17/003 340/901
9,174,598 B2 11/2015 Harada et al.

FOREIGN PATENT DOCUMENTS

CN 109508003 A 3/2019

* cited by examiner

*Primary Examiner* — Michael V Kerrigan
(74) *Attorney, Agent, or Firm* — Dickinson Wright PLLC

(57) ABSTRACT

A method includes generating a construction path for the autonomous construction vehicle and at least one other vehicle. The method also includes identifying at least one possible collision zone in the construction path. The method also includes, in response to identifying the at least one possible collision zone: dividing the construction path into one or more sections; determining all possible collision combinations; and identifying one or more collision zones based on the possible collision combinations. The method also includes selectively controlling, using data from one or more sensors associated with one or more of the autonomous construction vehicle and the at least one other vehicle associated with the construction site, at least the autonomous construction vehicle based on the possible collision zones.

20 Claims, 10 Drawing Sheets

SYSTEM AND METHOD FOR DISPATCH CONTROL FOR AUTONOMOUS DRIVING ENGINEERING

TECHNICAL FIELD

This disclosure relates to formation operation dispatch of engineering machinery, and particularly relates to a dispatch control method for autonomous driving engineering.

BACKGROUND

The construction operation of the construction vehicle is conducted in accordance to a construction process and technology, and as required by the operation requirements of relevant specifications. In of a construction process of the manned construction vehicle, a driver of a construction vehicle can flexibly control the speed and distance of the vehicle according to a construction site state on the premise of meeting given construction technology requirements. In this way, a collision can be avoided.

However, the manned driving engineering construction is faced with a tough environment, low efficiency, high energy consumption, a high labor cost, etc. Thus, it is an industrial trend to develop the smart construction vehicle and the unmanned construction. With the development of technology, the unmanned construction has been gradually employed in the industry.

Further, in a construction process of the unmanned construction vehicle, only when a construction process and a construction technology of an autonomous driving construction vehicle is preset, can the unmanned vehicle complete an engineering construction task orderly and automatically. For example, during the road construction of an engineering vehicle, a construction path, a technological process, etc. of an unmanned construction vehicle need to be effectively dispatched and set through the rational design and the efficient algorithm.

SUMMARY

This disclosure relates generally to autonomous control of construction vehicles.

An aspect of the disclosed embodiments includes a method for dispatch control of an autonomous construction vehicle. The method includes generating, for a construction site, a construction path for the autonomous construction vehicle and at least one other vehicle associated with the construction site. The method also includes identifying at least one possible collision zone in the construction path for at least the autonomous construction vehicle and the at least one other vehicle associated with the construction site. The method also includes, in response to identifying the at least one possible collision zone for at least the autonomous construction vehicle and the at least one other vehicle associated with the construction site: dividing the construction path into one or more sections; determining all possible collision combinations between at least the autonomous construction vehicle and the at least one other vehicle associated with the construction site; and identifying one or more collision zones associated with at least one of the one or more sections of the construction path based on the possible collision combinations. The method also includes selectively controlling, using data from one or more sensors associated with one or more of the autonomous construction vehicle and the at least one other vehicle associated with the construction site, at least the autonomous construction vehicle based on the possible collision zones.

Another aspect of the disclosed embodiments includes a system for dispatch control of an autonomous construction vehicle. The system includes a processor and a memory. The memory includes instructions that, when executed by the processor, cause the processor to: generate, for a construction site, a construction path for the autonomous construction vehicle and at least one other vehicle associated with the construction site; identify at least one possible collision zone in the construction path for at least the autonomous construction vehicle and the at least one other vehicle associated with the construction site; in response to identifying the at least one possible collision zone for at least the autonomous construction vehicle and the at least one other vehicle associated with the construction site: divide the construction path into one or more sections; determine all possible collision combinations between at least the autonomous construction vehicle and the at least one other vehicle associated with the construction site; and identify one or more collision zones associated with at least one of the one or more sections of the construction path based on the possible collision combinations; and selectively control, using data from one or more sensors associated with one or more of the autonomous construction vehicle and the at least one other vehicle associated with the construction site, at least the autonomous construction vehicle based on the possible collision zones.

Another aspect of the disclosed embodiments includes an apparatus for dispatch control of an autonomous construction vehicle. The apparatus includes a processor and a memory. The memory includes instructions that, when executed by the processor, cause the processor to: generate, for a construction site, a construction path for the autonomous construction vehicle and at least one other vehicle associated with the construction site; identify at least one possible collision zone in the construction path for at least the autonomous construction vehicle and the at least one other vehicle associated with the construction site; in response to identifying the at least one possible collision zone for at least the autonomous construction vehicle and the at least one other vehicle associated with the construction site: divide the construction path into one or more sections; determine whether a first collision condition exists; in response to a determination that the first collision condition does not exist, determine whether a second collision condition exists; in response to a determination that the second collision condition does not exist, determine whether a third collision condition exists; in response to determining that none of the first collision condition, the second collision condition, and the third collision condition exist, determine that no possible collision combinations exist; in response to determining that at least one of the first collision condition the second collision condition, and the third collision condition exist, identify all possible collision combinations between at least the autonomous construction vehicle and the at least one other vehicle associated with the construction site associated with the at least one of the at least one of the first collision condition the second collision condition, and the third collision condition; and identify one or more collision zones associated with at least one of the one or more sections of the construction path based on the possible collision combinations; and selectively control, using data from one or more sensors associated with one or more of the autonomous construction vehicle and the at least one other vehicle associated with the construction site, at least the autonomous construction vehicle based on the possible collision zones.

These and other aspects of the present disclosure are disclosed in the following detailed description of the embodiments, the appended claims, and the accompanying figures.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
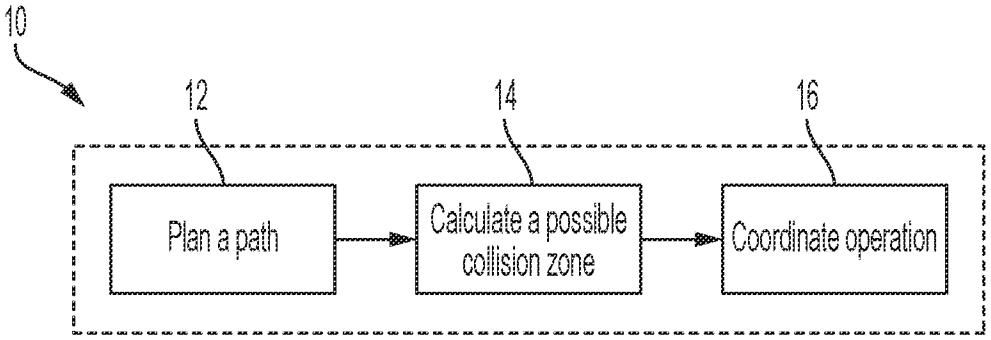
FIG. 1 generally illustrates a method according to the principles of the present disclosure.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the embodiments described herein, it should be understood that the terms "center", "longitudinal", "transverse", "up", "down", "front", "back", "left", "right", "vertical", "horizontal", "top", "bottom", "inner", "outer", etc. indicate those orientations and positional relations based on the orientations or positional relations shown in the accompanying drawings and are merely for ease of the descriptions of the present invention and simplicity, instead of indicating or implying that a device or element indicated must have a particular orientation, and be constructed and operated in a particular orientation, and are therefore not to be construed as limiting the present disclosure. In addition, the terms "first", "second", etc. are merely used for descriptive purposes, instead of being construed as indicating or implying relative importance or implicitly indicating the number of technical features indicated. Thus, features defined as "first", "second", etc. may include one or more features, either explicitly or implicitly. In the descriptions of the present invention, "multiple" means two or more, unless otherwise indicated.

In the embodiments described herein, it should be noted that, unless otherwise explicitly specified and limited, the terms "mounted", "connected", and "connection" should be understood in a broad sense, and for example, it may be fixed connection, detachable connection, integrated connection, mechanical connection, electric connection, direct connection, indirect connection through an intermediate medium, or communication between interiors of two elements. For a person of ordinary skill in the art, the specific meanings of the terms mentioned above in the present invention may be understood under specific conditions.

As described, the construction operation of the construction vehicle is conducted in accordance to a construction process and technology, and as required by the operation requirements of relevant specifications. In of a construction process of the manned construction vehicle, a driver of a construction vehicle can flexibly control the speed and distance of the vehicle according to a construction site state on the premise of meeting given construction technology requirements. In this way, a collision can be avoided.

However, manned driving engineering construction is faced with a tough environment, low efficiency, high energy consumption, a high labor cost, and the like. Thus, it is an industrial trend to develop smart construction vehicle for providing unmanned construction. With the development of technology, the unmanned construction has been gradually employed in the industry.

Further, in a construction process of the unmanned construction vehicle, only when a construction process and a construction technology of an autonomous driving construction vehicle is preset, can the unmanned vehicle complete an engineering construction task orderly and automatically. For example, during the road construction of an engineering vehicle, a construction path, a technological process, and the like, of an unmanned construction vehicle need to be effectively dispatched and set through the rational design and the efficient algorithm.

Apart from ensuring that a path of each construction vehicle is optimized, it is required to avoid the collision and the interference between the vehicles on the premise of ensuring the construction efficiency, especially in the overlapping and intersecting area in the construction process.

Accordingly, systems and methods, such as those described herein, configured to provide a dispatch control method for autonomous driving engineering, may be desirable. In some embodiments, the systems and methods described herein may be configured to rationally plan an operation path of the unmanned construction vehicle. The systems and methods described herein may be configured to reasonable predict a vehicle collision. The systems and methods described herein may be configured to avoid path overlapping and intersecting and to avoid collision. The systems and methods described herein may be configured to control the unmanned construction smoothly, and complete the construction task efficiently by the construction vehicle dispatched based on the optimized speed strategy.

In some embodiments, the systems and methods described herein may be configured to provide a dispatch control method for autonomous driving engineering, to avoid a collision between multiple construction vehicles in path construction and dispatch multiple construction vehicles. The systems and methods described herein may be configured to dispatch control method for autonomous driving engineering includes. For example, the systems and methods described herein may be configured to: plan a construction path of each vehicle; calculate a possible collision zone in the construction path of each vehicle according to a planned construction path; and coordinate operation of multiple vehicles according to the possible collision zone. The systems and methods described herein may be configured to, when the possible collision zone in the construction path of each vehicle is calculated, divide the construction path into modules and carry out different collision combinations of a construction vehicle on the module. The systems and methods described herein may be configured to detect different collision combinations to calculate the possible collision zone.

In some embodiments, the systems and methods described herein may be configured to plan a construction path by: driving a paver to operate by a driver; recording path information in real time through a global positioning system (GPS) device mounted on the paver; and, obtaining, based on the path information of the paver, path planning of other construction vehicles through a construction path translation algorithm.

In some embodiments, the systems and methods described herein may be configured to perform the construction path translation algorithm by: given that longitude and latitude coordinates of a path point of a center line of a to-be-paved area are <$lon_i$, $lat_i$, $heading_i$>, a paving width of the paver is $w_t$, an effective road rolling width of a road roller is $w_y$ a left and right margin width of the to-be-paved area is $w_{edge}$, and an overlapping width of a lane is $w_{overlap}$, firstly, transversely translating the path point of the center line to a position obtained by subtracting a margin distance from the rightmost boundary, a translation distance being ½ ($w_y$-$w_{edge}$) and then leftwards translating the path point by taking the translation distance as a reference to obtain a path point of the road roller in each lane, a translation distance of a first lane being ½ ($w_y$) distance, and a translation distance of other lanes being $lane_i$*$w_y$−($lane_i$−1)*$w_{overlap}$−½ $w_y$ where $lon_i$ denotes a longitude, $lat_i$ denotes a latitude, $heading_i$ denotes a heading angle, and $lane_i$=2, 3, . . . denotes a lane number.

In some embodiments, the systems and methods described herein may be configured to calculate a possible collision zone in the construction path of each vehicle by: determining whether the construction path of each vehicle intersects; calculating the possible collision zone and executing the following steps in the presence of an intersection, and not calculating the possible collision zone in the absence of an intersection and a collision; determining a construction vehicle in each construction path; selecting different collision combinations according to conditions of different construction vehicles; carrying out collision detection according to a collision detection condition; and calculating the possible collision zone according to different collision combinations and different collision detection.

In some embodiments, the systems and methods described herein may be configured to determine various collision combinations, which may include collision combinations (a,b), (a,c), (b,c), . . . (m,n) when there is one construction vehicle in each construction path, and vehicles in multiple construction paths include a, b, c, . . . n, where a, b, c, m, and n denote different vehicles. The systems and methods described herein may be configured to determine various collision combinations, such as collision combinations [a, (b1,b2)], [b1, (a,c1,c2)], [b2, (a,c2,c3)], . . . [n(n+1), n(n−1), nn)] when there is one or more construction vehicles in each construction path (e.g., a vehicle a in the first path, vehicles b1 and b2 in the second path, vehicles c1, c2, and c3 in the third path, and vehicles n1, n2 . . . n (n+1) in the nth path, n+1 denoting the n+1th vehicle).

In some embodiments, the systems and methods described herein may be configured to detect collision conditions including: a first condition where the vehicles overlap and intersect partially in a parallel direction; a second condition where the vehicles intersect obliquely during operation; and a third condition where the vehicles overlap completely during operation. It should be understood that the systems and methods described herein may be configured to detect any suitable collision conditions or combinations in addition to or instead of those described herein.

In some embodiments, possible collision zones include: for a collision between vehicles in the same path, a vehicle overlapping area; and for a collision between vehicles in different paths, a lane change area and a sawtooth area (e.g., where the vehicles in different paths in a construction area collide in a construction process, where a lane change area of a vehicle in each construction area is arranged at the beginning of the construction area, and a sawtooth area is arranged at an intersection between a current construction area and a next construction area). Considering collision areas A and B as examples, collision conditions of two vehicles include the following three conditions: 1: a vehicle 2 in an area B is on the right side of a vehicle 1 in an area A, the vehicle 1 in the area A goes straight forward and the vehicle 2 in the area B goes straight backward, and the vehicle 1 in the area A goes straight backward and the vehicle 2 in the area B goes straight backward; 2: the vehicle 2 in the area B is on the right side of the vehicle 1 in the area A, the vehicle 1 in the area A goes straight forward and the vehicle 2 in the area B changes a lane and goes curvilinearly forward, and the vehicle 1 in the area A goes straight backward and the vehicle 2 in the area B changes a lane and goes curvilinearly forward, and the vehicle 2 in the area B is on the left side of the vehicle 1 in the area A, the vehicle 1 in the area A goes straight forward and the vehicle 2 in the area B changes a lane and goes curvilinearly forward; and 3: the vehicle 2 in the area B is on the left side of the vehicle 1 in the area A, the vehicle 1 in the area A goes straight forward and the vehicle 2 in the area B changes a lane and goes curvilinearly forward, and the vehicle 1 in the area A goes straight backward and the vehicle 2 in the area B changes a lane and goes curvilinearly forward.

In some embodiments, the systems and methods described herein may be configured to coordinate operation of multiple vehicles by inputting global path points {<xi, yi, θi>} of all vehicles, i=1 . . . n; and inputting real-time data {vehicle identity (id), pose, gear, lane number, area number} of all vehicles, and initial speeds {v0_1, v0_2, . . . , v0_n} of all vehicles, where xi, yi denotes current coordinates, θi denotes a heading angle of a vehicle, and v0_n denotes an initial speed of the nth vehicle. The systems and methods described herein may be configured to analyze a static global path of each vehicle, to obtain path points {$Vehicle_i$: {$Lane_j$: {$Region_k$:{$Point_i$, . . . , $Point_n$}}} of the vehicle in all areas of each lane, where $Vehicle_i$ denotes a vehicle number, $Lane_j$ denotes a lane number, $Region_k$ denotes an area number, and $Point_n$ denotes a path point.

In some embodiments, the systems and methods described herein may be configured to calculating a collision area of each vehicle in each lane. The systems and methods described herein may be configured to prevent a transverse collision between parallel vehicles constructing in the same module in a synchronous manner (e.g., enabling the parallel vehicles to keep the same speed all the time. The systems and methods described herein may be configured to add a vehicle, which is likely to collide into a set. The systems and methods described herein may be configured to acquire a position where the vehicle reaches a boundary of the collision area of the lane according to a lane number provided by real-time data of the vehicle. The systems and methods described herein may be configured to calculate whether two vehicles have an intersection area. The systems and methods described herein may be configured to calculate a time when the vehicle reaches the boundary of the collision area in the presence of the intersection area. The systems and methods described herein may be configured to enable a vehicle which reaches the boundary earlier to pass first, and the other vehicle to wait at the boundary.

In some embodiments, the systems and methods described herein may be configured to effectively and rationally plan an operation path of each vehicle participating in construction, so as to assign each vehicle a definite operation task. The systems and methods described herein may be configured to rationally predict and control the collision condition and the possible collision zone of the vehicle, so as to avoid a collision and mutual interference between the vehicles from the perspective of task issuing and the operation path. The systems and methods described herein may be configured to divide the construction area and coordinate and control the multiple vehicles, so as to further realize unmanned formation operation. The systems and methods described herein may be configured to provide improved efficient, safe, reliable operation of unmanned construction of an engineering machinery vehicle. The systems and methods described herein may be configured to provide comprehensive smart and unmanned construction operation in an engineering machinery industry is popularized and promoted.

With reference to FIG. 1, a dispatch control method 10 for autonomous driving engineering is generally illustrated. At 12, the method 10 may plan a construction path for each vehicle. At 14, the method 10 may calculate a possible collision zone in the construction path of each vehicle according to the planned construction path. For example, the method 10 may, when the possible collision zone in the construction path of each vehicle is calculated, divide the construction path into modules (e.g., with may include sections, portions, and the like of the construction path). The method 10 may determine various collision combinations of a construction vehicle on a module. For example, the method 10 may include carrying out (e.g., performing virtually and the like) the various collision combinations to identify possible collision scenarios of the vehicles on the construction path. The method 10 may detect the various collision combinations to calculate or identify the possible collision zone. At 16, the method 10 may coordinate operation of multiple vehicles according to the possible collision zone.

Figure 9:
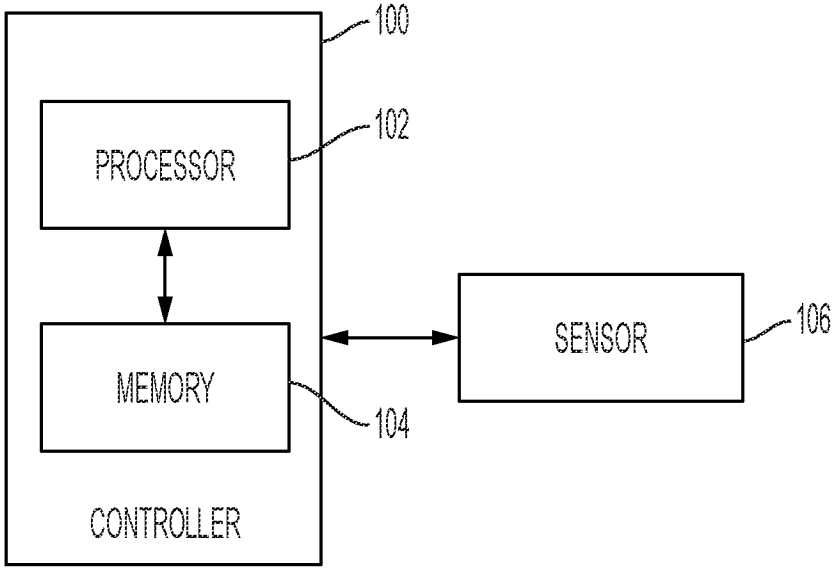
FIG. 9 generally illustrates a controller according to the principles of the present disclosure.

In some embodiments, the method 10 may be performed by a controller, such as the controller 100 as is generally illustrated in FIG. 9. The controller 100 may include any suitable controller, such as an electronic control unit or other suitable controller. The controller 100 may be disposed or associated with a construction vehicle associated with a construction path. The construction vehicle may include an autonomous or semi-autonomous vehicle, as described. The construction vehicle may include any suitable vehicle, such as a paver or other suitable construction vehicle. The controller 100 may be configured to control, for example, the various functions of the vehicle. The controller 100 may include a processor 102 and a memory 104. The processor 102 may include any suitable processor, such as those described herein. Additionally, or alternatively, the controller 100 may include any suitable number of processors, in addition to or other than the processor 102. The memory 104 may comprise a single disk or a plurality of disks (e.g., hard drives), and includes a storage management module that manages one or more partitions within the memory 104. In some embodiments, memory 104 may include flash memory, semiconductor (solid state) memory or the like. The memory 104 may include Random Access Memory (RAM), a Read-Only Memory (ROM), or a combination thereof. The memory 104 may include instructions that, when executed by the processor 102, cause the processor 102 to, at least, control various aspects of the vehicle.

The controller 100 may receive one or more signals from various measurement devices or sensors 106 indicating sensed or measured characteristics of the vehicle. The sensors 106 may include any suitable sensors, measurement devices, and/or other suitable mechanisms. For example, the sensors 106 may include one or more GPS sensors, one or more light detection and ranging (LiDAR) sensors, one or more radio detection and ranging (radar) sensors, one or more sound navigation and ranging (sonar) sensor, one or more position sensors, one or more image capturing sensors (e.g., such as a camera), one or more other suitable sensors or devices, or a combination thereof. The one or more signals may indicate a position of the vehicle (e.g., including GPS coordinates), positions of other objects in the environment of the vehicle, other suitable information, or a combination there.

In some embodiments, the controller 100 may be associated with a computing device that is remotely located from the vehicle. For example, the controller 100 may be associated with a cloud computing device, a desktop computing device, a laptop computing device, a mobile computing device, and/or the like. It should be understood that the systems and methods described herein may be performed using any suitable computing device, controller, or a combination thereof.

In some embodiments, the controller 100 may perform the methods described herein. However, the methods described herein as performed by the controller 100 are not meant to be limiting, and any type of software executed on a computing device or a combination of various computing devices can perform the methods described herein without departing from the scope of this disclosure.

The controller 100 may plan a construction path. For example, the controller 100 may receive sensor data from the sensors 106 during operation (e.g., by an operator or driver) of the vehicle. The controller 100 may record path information in real time (e.g., using GPS information). The controller 100 may obtain, based on the path information of the vehicle, path planning of other construction vehicles through a construction path translation algorithm.

In some embodiments, the controller 100 may perform the construction path translation algorithm by: given that longitude and latitude coordinates of a path point of a center line of a to-be-paved area are $<lon_i, lat_i, heading_i>$, a paving width of the paver is $w_t$, an effective road rolling width of a road roller is $w_y$, a left and right margin width of the to-be-paved area is $w_{edge}$, and an overlapping width of a lane is $w_{overlap}$, firstly, transversely translating the path point of the center line to a position obtained by subtracting a margin distance from the rightmost boundary, a translation distance being ½ ($w_y$−$w_{edge}$) and then leftwards translating the path point by taking the translation distance as a reference to obtain a path point of the road roller in each lane, a translation distance of a first lane being ½ ($w_y$) distance, and a translation distance of other lanes being $lane_i$*$w_y$−($lane_i$−1)*$w_{overlap}$−½ $w_y$ where $lon_i$ denotes a longitude, $lat_i$ denotes a latitude, $heading_i$ denotes a heading angle, and $lane_i$=2, 3, . . . denotes a lane number.

In some embodiments, the controller 100 may calculate a possible collision zone in the construction path of each vehicle by: determining whether the construction path of each vehicle intersects; calculating the possible collision zone and executing the following steps in the presence of an intersection, and not calculating the possible collision zone in the absence of an intersection and a collision; determining a construction vehicle in each construction path; selecting different collision combinations according to conditions of different construction vehicles; carrying out collision detection according to a collision detection condition; and calculating the possible collision zone according to different collision combinations and different collision detection.

In some embodiments, the controller 100 may determine various collision combinations, which may include collision combinations (a,b), (a,c), (b,c), . . . (m,n) when there is one construction vehicle in each construction path, and vehicles in multiple construction paths include a, b, c, . . . n, where a, b, c, m, and n denote different vehicles. The systems and methods described herein may be configured to determine various collision combinations, such as collision combinations [a, (b1,b2)], [b1, (a,c1,c2)], [b2, (a,c2,c3)], . . . [n(n+1), n(n−1), nn)] when there is one or more construction vehicles in each construction path (e.g., a vehicle a in the first path, vehicles b1 and b2 in the second path, vehicles c1, c2, and c3 in the third path, and vehicles n1, n2 . . . n (n+1) in the nth path, n+1 denoting the n+1th vehicle).

Figure 5:
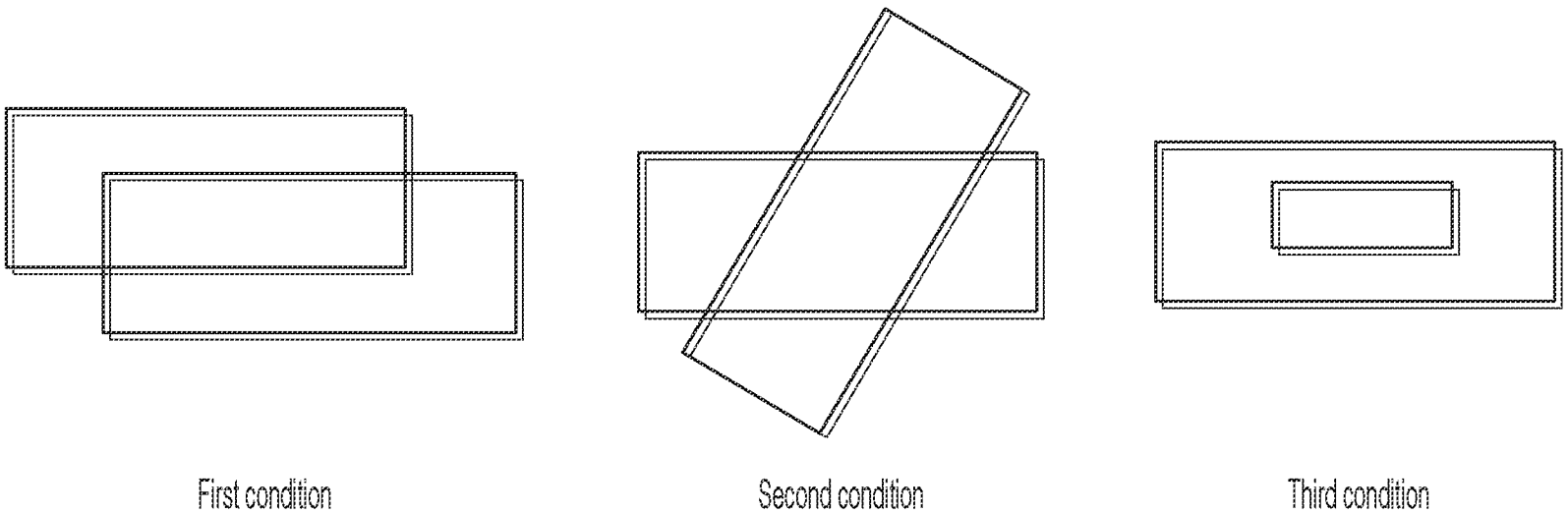
FIG. 5 generally illustrates a schematic diagram of the collision detection principles of the present disclosure.

With reference to FIG. 5, in some embodiments, the controller 100 may detect collision conditions including: a first condition where the vehicles overlap and intersect partially in a parallel direction; a second condition where the vehicles intersect obliquely during operation; and a third condition where the vehicles overlap completely during operation. It should be understood that the controller 100 may detect any suitable collision conditions or combinations in addition to or instead of those described herein.

Figure 2:
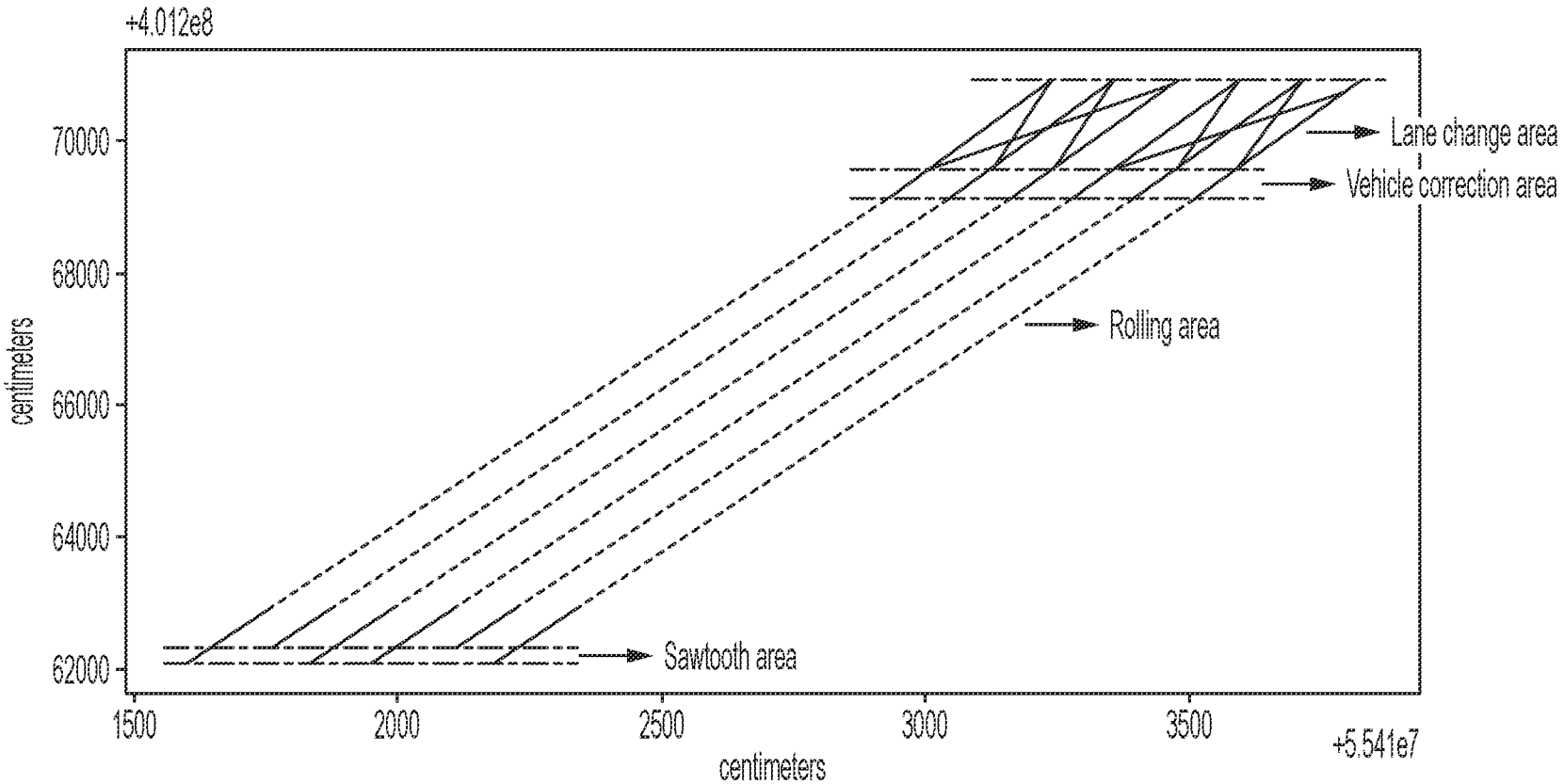
FIG. 2 generally illustrates a schematic diagram of a path planning principles of the present disclosure.
Figure 7:
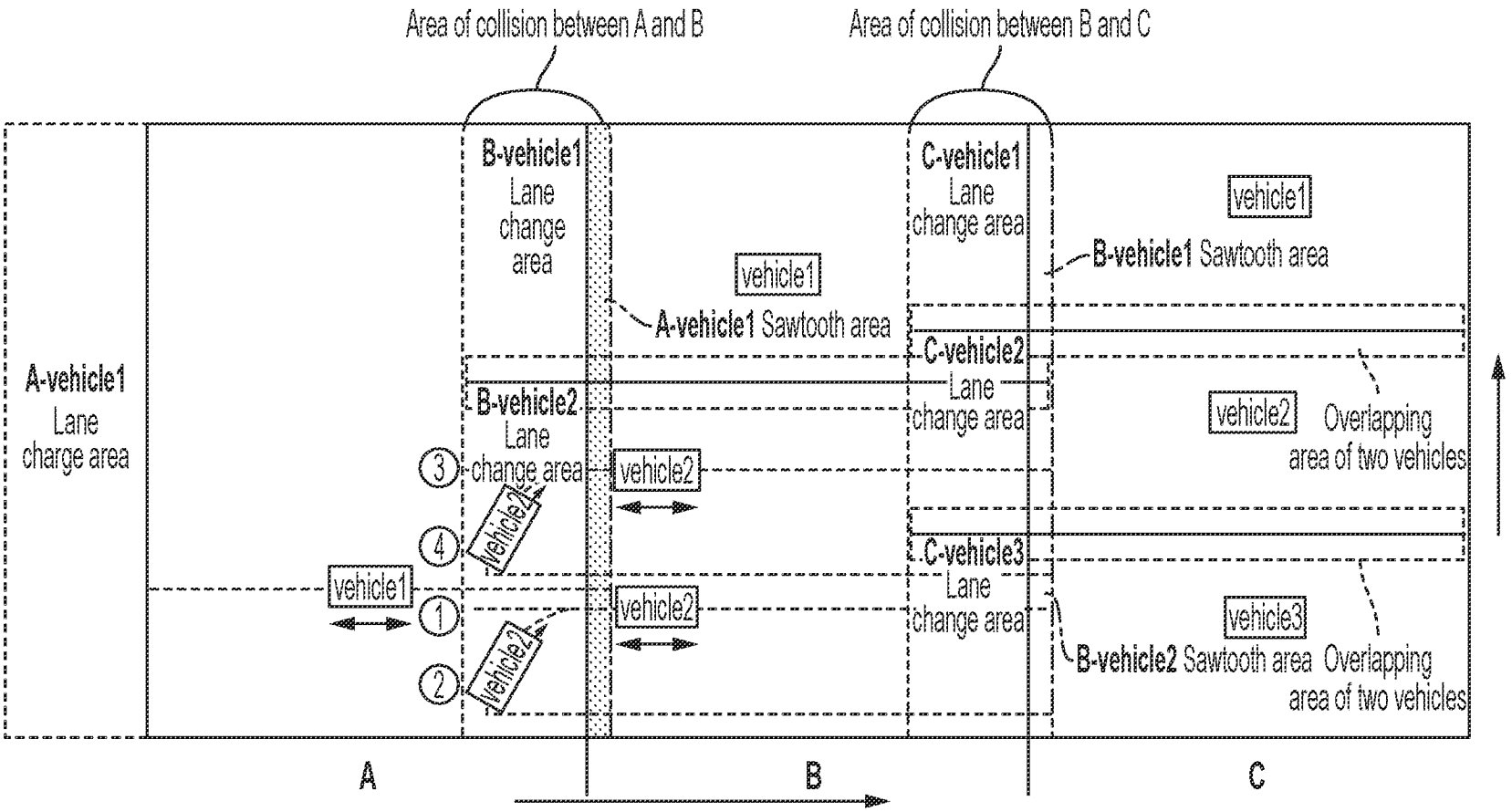
FIG. 7 generally illustrates a second schematic diagram of the calculating a possible collision zone principles of the present disclosure.

In some embodiments, possible collision zones include: for a collision between vehicles in the same path, a vehicle overlapping area; and, as is generally illustrated in FIGS. 2 and 7, for a collision between vehicles in different paths, a lane change area and a sawtooth area (e.g., where the vehicles in different paths in a construction area collide in a construction process, where a lane change area of a vehicle in each construction area is arranged at the beginning of the construction area, and a sawtooth area is arranged at an intersection between a current construction area and a next construction area). Considering collision areas A and B as examples, collision conditions of two vehicles include the following three conditions: 1: a vehicle 2 in an area B is on the right side of a vehicle 1 in an area A, the vehicle 1 in the area A goes straight forward and the vehicle 2 in the area B goes straight backward, and the vehicle 1 in the area A goes straight backward and the vehicle 2 in the area B goes straight backward; 2: the vehicle 2 in the area B is on the right side of the vehicle 1 in the area A, the vehicle 1 in the area A goes straight forward and the vehicle 2 in the area B changes a lane and goes curvilinearly forward, and the vehicle 1 in the area A goes straight backward and the vehicle 2 in the area B changes a lane and goes curvilinearly forward, and the vehicle 2 in the area B is on the left side of the vehicle 1 in the area A, the vehicle 1 in the area A goes straight forward and the vehicle 2 in the area B changes a lane and goes curvilinearly forward; and 3: the vehicle 2 in the area B is on the left side of the vehicle 1 in the area A, the vehicle 1 in the area A goes straight forward and the vehicle 2 in the area B changes a lane and goes curvilinearly forward, and the vehicle 1 in the area A goes straight backward and the vehicle 2 in the area B changes a lane and goes curvilinearly forward.

In some embodiments, the controller 100 may coordinate operation of multiple vehicles by inputting global path points {<xi, yi, θi>} of all vehicles, i=1 . . . n; and inputting real-time data {vehicle identity (id), pose, gear, lane number, area number} of all vehicles, and initial speeds {v0_1, v0_2, . . . , v0_n} of all vehicles, where xi, yi denotes current coordinates, θi denotes a heading angle of a vehicle, and v0_n denotes an initial speed of the nth vehicle. The systems and methods described herein may be configured to analyze a static global path of each vehicle, to obtain path points {$Vehicle_i$: {$Lane_j$:{$Region_k$:{$Point_i$, . . . , $Point_n$}}} of the vehicle in all areas of each lane, where $Vehicle_i$ denotes a vehicle number, $Lane_j$ denotes a lane number, $Region_k$ denotes an area number, and $Point_n$ denotes a path point.

In some embodiments, the controller 100 may calculate a collision area of each vehicle in each lane. The systems and methods described herein may be configured to prevent a transverse collision between parallel vehicles constructing in the same module in a synchronous manner (e.g., enabling the parallel vehicles to keep the same speed all the time. The systems and methods described herein may be configured to add a vehicle, which is likely to collide into a set. The systems and methods described herein may be configured to acquire a position where the vehicle reaches a boundary of the collision area of the lane according to a lane number provided by real-time data of the vehicle. The controller 100 may determine whether two vehicles have an intersection area. The controller 100 may determine a time when the vehicle reaches the boundary of the collision area in the presence of the intersection area. The controller 100 may enable a vehicle which reaches the boundary earlier to pass first, and the other vehicle to wait at the boundary.

Figure 3:
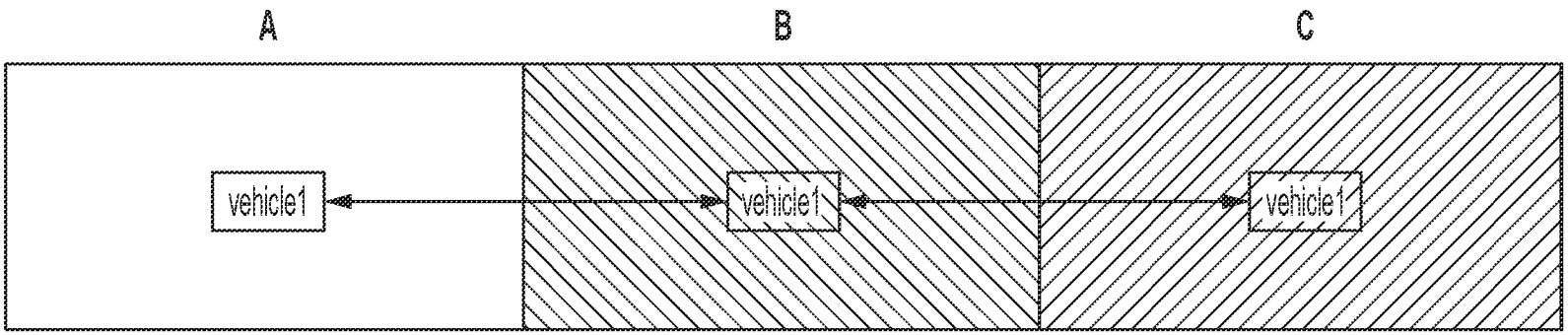
FIG. 3 generally illustrates a schematic diagram of each path with one construction vehicle principles of the present disclosure.

In some embodiments, the controller 100 may divide the collision area into sections (e.g., which may be referred to modules herein). For example, as is generally illustrated in FIG. 3, the controller 100 may calculate a construction area of each vehicle. If the construction area of the vehicle intersects, a collision may occur, and if the construction area of the vehicle does not intersect, no collision will occur. There may be one construction vehicle in each path, and collision combinations may include [a-forward, b-back], [b-forward, c-back], [b-back, a-forward], and [c-back, b-forward], where a-forward denotes that a vehicle a goes forward, and b-back denotes that a vehicle b goes backward.

Figure 4:
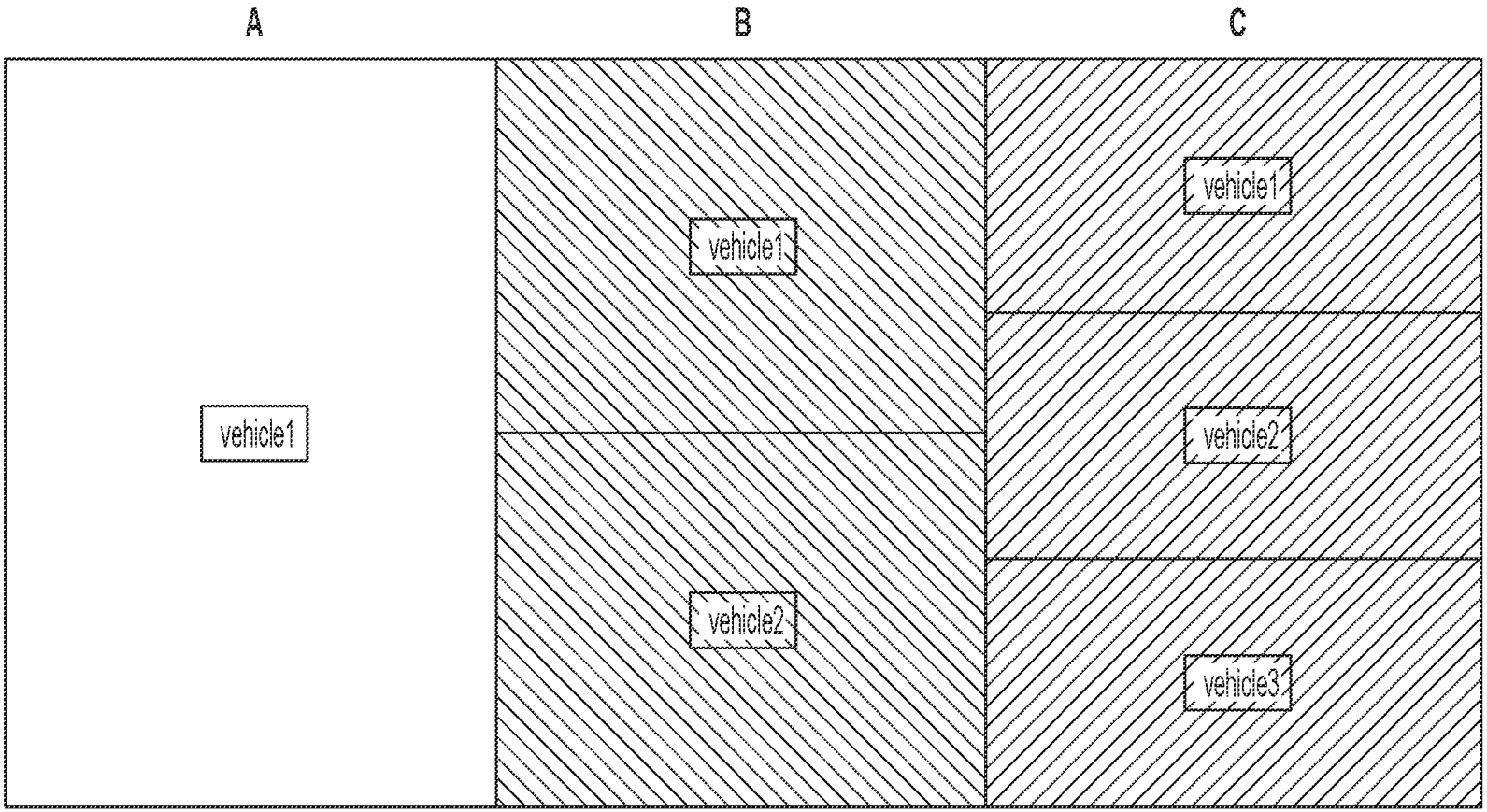
FIG. 4 generally illustrates a schematic diagram of each path with multiple construction vehicles principles of the present disclosure.

As is generally illustrated in FIG. 4, there may be one or more construction vehicles in each module, and collision combinations may include A-vehicle1 and [B-vehicle1, B-vehicle2], B-vehicle1 and [A-vehicle1, C-vehicle1, C-vehicle2], B-vehicle2 and [A-vehicle1, C-vehicle2, C-vehicle3], C-vehicle1 and B-vehicle1, C-vehicle2 and [B-vehicle1, B-vehicle2], and C-vehicle3 and B-vehicle2.

As is generally illustrated in FIG. 5, the controller 100 may, for collision detection of two vehicles (rectangular), identify a number of conditions (e.g., such as three conditions or other suitable number of conditions). For example, the controller 100 may perform a specific detection algorithm by: detecting whether it is the first condition, determining whether it is the second or third condition if it is not the first condition, and determining that no intersection will occur if none of three conditions are satisfied.

The first condition may include a condition where the vehicles overlap and intersect partially in a parallel direction. The second condition may include a condition where the vehicles intersect obliquely during operation. The third condition may include a condition where the vehicles overlap completely during operation.

Figure 6:
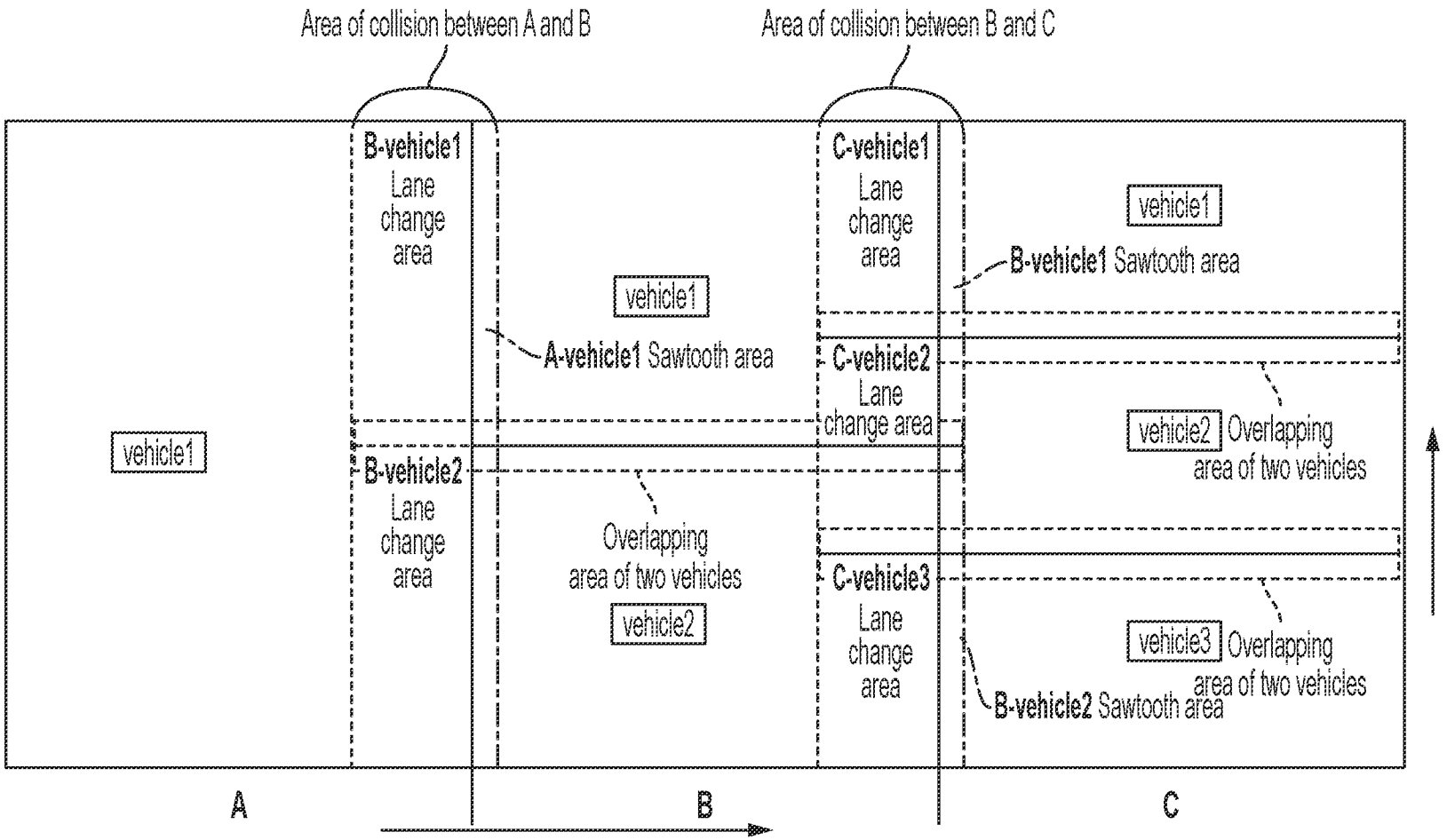
FIG. 6 generally illustrates a first schematic diagram of the calculating a possible collision zone principles of the present disclosure.

In some embodiments, the possible collision zones may include: a possible collision zone of vehicles in the same module, such as an overlapping area of the two vehicles, that is, a dotted box area as shown in FIG. 6, only for a collision between the vehicles in the same module; and a possible collision zone of vehicles in different modules, as shown in FIGS. 6 and 7, for a collision between vehicles in different paths, that is only a lane change area and a sawtooth area where the vehicles in different paths in a construction area will collide in a construction process (e.g., where a lane change area of a vehicle in each construction area is arranged at the beginning of the construction area, and a sawtooth area is arranged at an intersection between a current construction area and a next construction area).

Considering collision areas A and B as examples, collision conditions of two vehicles may include the following three conditions: 1: a vehicle 2 in an area B is on the right side of a vehicle 1 in an area A, the vehicle 1 in the area A goes straight forward and the vehicle 2 in the area B goes straight backward, and the vehicle 1 in the area A goes straight backward and the vehicle 2 in the area B goes straight backward; 2: the vehicle 2 in the area B is on the right side of the vehicle 1 in the area A, the vehicle 1 in the area A goes straight forward and the vehicle 2 in the area B changes a lane and goes curvilinearly forward, and the vehicle 1 in the area A goes straight backward and the vehicle 2 in the area B changes a lane and goes curvilinearly forward; and the vehicle 2 in the area B is on the left side of the vehicle 1 in the area A, the vehicle 1 in the area A goes straight forward and the vehicle 2 in the area B changes a lane and goes curvilinearly forward; and 3: the vehicle 2 in the area B is on the left side of the vehicle 1 in the area A, the vehicle 1 in the area A goes straight forward and the vehicle 2 in the area B changes a lane and goes curvilinearly forward, and the vehicle 1 in the area A goes straight backward and the vehicle 2 in the area B changes a lane and goes curvilinearly forward.

In some embodiments, the controller 100 may coordinate vehicle operation. For example, in order to coordinate the vehicle to avoid a collision in the collision area, the controller 100 may determine that, before one vehicle passes through the own possible collision zone, another vehicle has already passed or has not started to pass. A path may be denoted by a set of state sequences {<xi, yi, θi>}, where xi, yi denotes current coordinates, and xi, yi denotes a heading angle of a vehicle. The controller 100 may take into consideration granularity when a path is divided into state sequences. For example, if the path is too large, collision detection will be inaccurate, and if the path is too small, collision detection time complexity will be too high. The vehicle may have an approximately rectangular contour. The controller 100 may solve a configuration space for each state from state information and contour information.

In some embodiments, a path may be denoted by a set of state sequences {<xi, yi, θi>}, where xi, yi denotes current coordinates, and θi denotes a heading angle of a vehicle. The controller 100 may solve a configuration space for each state based on the construction path translation algorithm, as described.

In some embodiments, the controller 100 may perform a vehicle operation coordination algorithm. For example, the controller 100 may receive input that may include: global path points {<xi, yi, θi>} of all vehicles, i=1 . . . n; real-time data {vehicle id, pose, gear, lane number, area number} of all vehicles; initial speeds {v0_1, v0_2, . . . , v0_n} of all vehicles; other suitable input, or a combination thereof. The controller 100 may generate output that may include real-time speeds {v1, v2, . . . , vn} of all vehicles and/or other suitable output.

In some embodiments, the controller 100 may analyze a static global path of each vehicle, to obtain path points {Vehiclei: {Lanej:{Regionk:{Pointi, . . . , Pointn}}} of the vehicle in all areas of each lane, where Vehiclei denotes a vehicle number, Lanej denotes a lane number, Regionk denotes an area number, and Pointn denotes a path point.

The controller 100 may calculate a collision area of each vehicle in each lane. The controller 100 may prevent a transverse collision between parallel vehicles operating (e.g., constructing) in the same module in a synchronous manner (e.g., that is, the controller 100 may enable the parallel vehicles to keep the same speed all the time. The controller 100 may add a vehicle which is likely to collide into a set, acquire a position where the vehicle reaches a boundary of the collision area of the lane to a lane number provided by real-time data of the vehicle, and calculate whether two vehicles have an intersection area. The controller 100 may calculate a time when the vehicle reaches the boundary of the collision area in the presence of the intersection area, and enable a vehicle which reaches the boundary earlier to pass first, and the other vehicle to wait at the boundary.

Figure 8:
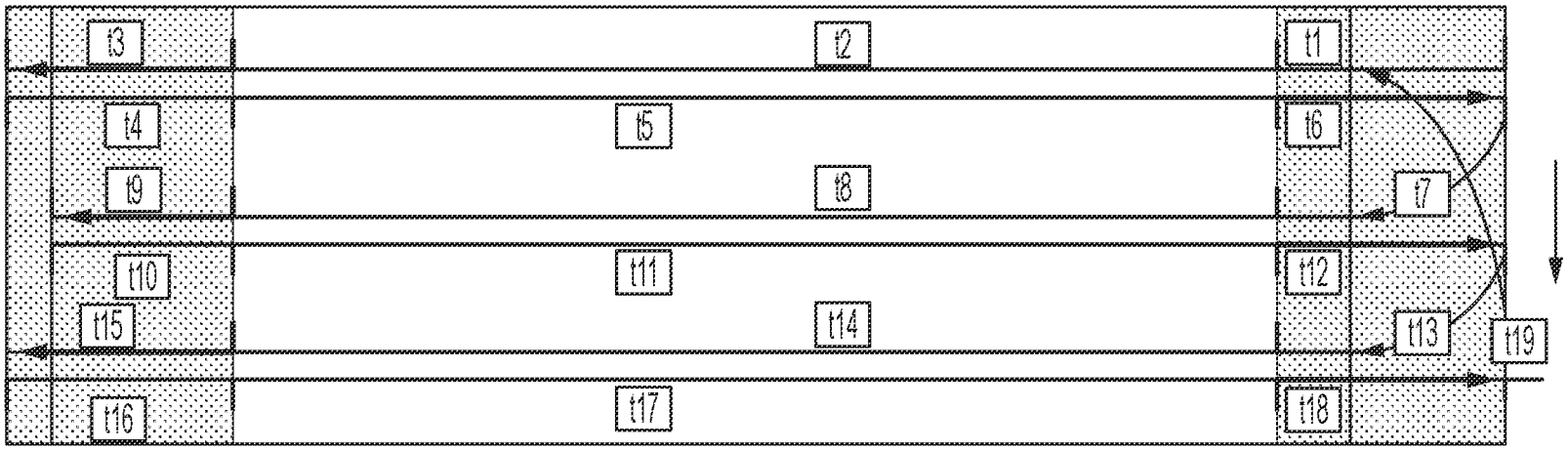
FIG. 8 generally illustrates a schematic diagram of the embodiment principles of the present disclosure.

As shown in FIG. 8, the controller 100 may, according to a vehicle operation coordination rule, determine whether parallel vehicles will collide and, in response to identifying vehicles that may collide, organize all vehicles which may collide with all other vehicles into a stack first by dividing a construction area. As is illustrated, when in a zone t1, the vehicle will not collide with other vehicles. When in a zone t2, the controller 100 may account for a vehicle that may change a lane in a left module. When in a zone t5, the controller 100 may account for a vehicle constructing in a right module. When in a zone t7, the controller 100 may account for a vehicle constructing in a right module. The controller 100 may instruct the vehicle to wait at a possible collision zone t3, t4 or t6 or pass there through, and the same applies to other zones.

In some embodiments, the controller 100 may be configured to provide autonomous control for one or more construction vehicles, as described. For example, the controller 100 may generate, for a construction site, a construction path for the autonomous construction vehicle and at least one other vehicle associated with the construction site. The controller 100 may identify at least one possible collision zone in the construction path for at least the autonomous construction vehicle and the at least one other vehicle associated with the construction site. The at least one possible collision zone may include a possible collision zone that includes at least the autonomous construction vehicle and the at least one other vehicle associated with the construction site in the same section of the construction path, a possible collision zone that includes at least the autonomous construction vehicle and the at least one other vehicle associated with the construction site in different sections of the construction path, other possible collision zones, or a combination thereof.

The controller 100 may, in response to identifying the at least one possible collision zone for at least the autonomous construction vehicle and the at least one other vehicle associated with the construction site divide the construction path into one or more sections. The controller 100 may determine all possible collision combinations between at least the autonomous construction vehicle and the at least one other vehicle associated with the construction site. The controller 100 may identify one or more collision zones associated with at least one of the one or more sections of the construction path based on the possible collision combinations.

For example, the controller 100 may determine whether a first collision condition exists. The first collision condition may include a condition where at least the autonomous construction vehicle and the at least one other vehicle associated with the construction site overlap and intersect at least partially in a parallel direction. The controller 100 may, in response to a determination that the first collision condition does not exist, determine whether a second collision condition exists. The second collision condition may include a condition where at least the autonomous construction vehicle and the at least one other vehicle associated with the construction site intersect obliquely.

The controller 100 may, in response to a determination that the second collision condition does not exist, determine whether a third collision condition exists. The third collision condition may include a condition where at least the autonomous construction vehicle and the at least one other vehicle associated with the construction site completely overlap. The controller 100 may, in response to determining that none of the first collision condition, the second collision condition, and the third collision condition exist, determine that no possible collision combinations exist. The controller 100 may, in response to determining that at least one of the first collision condition the second collision condition, and the third collision condition exist, identify possible collision combinations associated with the at least one of the at least one of the first collision condition the second collision condition, and the third collision condition.

The controller 100 may selectively control, using data from one or more sensors associated with one or more of the autonomous construction vehicle and the at least one other vehicle associated with the construction site, at least the autonomous construction vehicle based on the possible collision zones.

In some embodiments, as described, the controller 100 may perform the methods described herein. However, the methods described herein as performed by the controller 100 are not meant to be limiting, and any type of software executed on a computing device or a combination of various computing devices can perform the methods described herein without departing from the scope of this disclosure.

Figure 10:
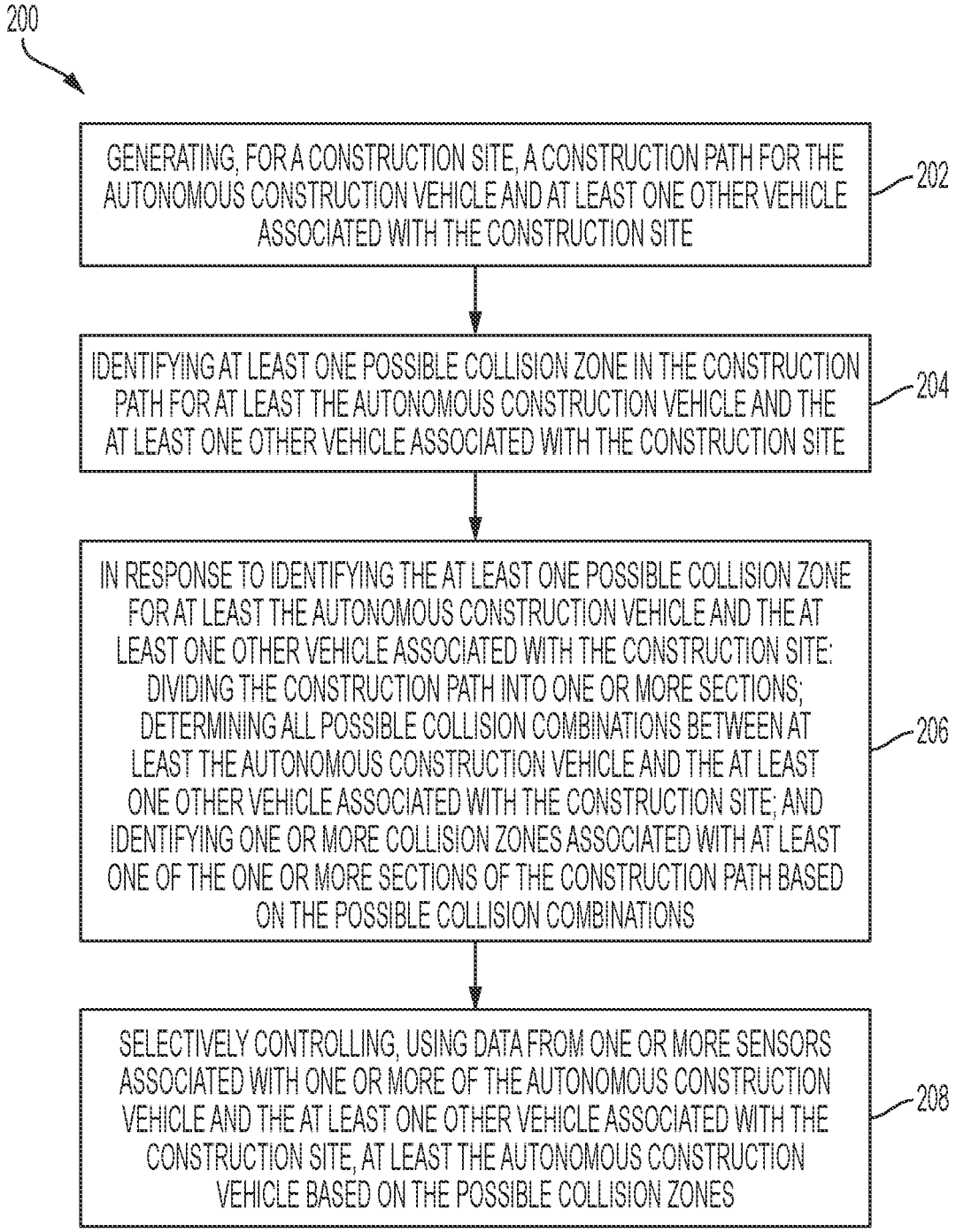
FIG. 10 is a flow diagram generally illustrating an autonomous construction vehicle control method according to the principles of the present disclosure.

FIG. 10 is a flow diagram generally illustrating an autonomous construction vehicle control method 200 according to the principles of the present disclosure. At 202, the method 200 generates, for a construction site, a construction path for the autonomous construction vehicle and at least one other vehicle associated with the construction site.

At 204, the method 200 identifies at least one possible collision zone in the construction path for at least the autonomous construction vehicle and the at least one other vehicle associated with the construction site.

At 206, the method 200, in response to identifying the at least one possible collision zone for at least the autonomous construction vehicle and the at least one other vehicle associated with the construction site: divides the construction path into one or more sections; determines all possible collision combinations between at least the autonomous construction vehicle and the at least one other vehicle associated with the construction site; and identifies one or more collision zones associated with at least one of the one or more sections of the construction path based on the possible collision combinations.

At 208, the method 200 selectively controls, using data from one or more sensors associated with one or more of the autonomous construction vehicle and the at least one other vehicle associated with the construction site, at least the autonomous construction vehicle based on the possible collision zones.

In some embodiments, a method for dispatch control of an autonomous construction vehicle includes generating, for a construction site, a construction path for the autonomous construction vehicle and at least one other vehicle associated with the construction site. The method also includes identifying at least one possible collision zone in the construction path for at least the autonomous construction vehicle and the at least one other vehicle associated with the construction site. The method also includes, in response to identifying the at least one possible collision zone for at least the autonomous construction vehicle and the at least one other vehicle associated with the construction site: dividing the construction path into one or more sections; determining all possible collision combinations between at least the autonomous construction vehicle and the at least one other vehicle associated with the construction site; and identifying one or more collision zones associated with at least one of the one or more sections of the construction path based on the possible collision combinations. The method also includes selectively controlling, using data from one or more sensors associated with one or more of the autonomous construction vehicle and the at least one other vehicle associated with the construction site, at least the autonomous construction vehicle based on the possible collision zones.

In some embodiments, the at least one possible collision zone includes a possible collision zone that includes at least the autonomous construction vehicle and the at least one other vehicle associated with the construction site in the same section of the construction path. In some embodiments, the at least one possible collision zone includes a possible collision zone that includes at least the autonomous construction vehicle and the at least one other vehicle associated with the construction site in different sections of the construction path. In some embodiments, determining all possible collision combinations between at least the autonomous construction vehicle and the at least one other vehicle associated with the construction site includes: determining whether a first collision condition exists; in response to a determination that the first collision condition does not exist, determining whether a second collision condition exists; in response to a determination that the second collision condition does not exist, determining whether a third collision condition exists; in response to determining that none of the first collision condition, the second collision condition, and the third collision condition exist, determining that no possible collision combinations exist; and, in response to determining that at least one of the first collision condition the second collision condition, and the third collision condition exist, identifying possible collision combinations associated with the at least one of the at least one of the first collision condition the second collision condition, and the third collision condition. In some embodiments, the first collision condition includes a condition where at least the autonomous construction vehicle and the at least one other vehicle associated with the construction site overlap and intersect at least partially in a parallel direction. In some embodiments, the second collision condition includes a condition where at least the autonomous construction vehicle and the at least one other vehicle associated with the construction site intersect obliquely. In some embodiments, the third collision condition includes a condition where at least the autonomous construction vehicle and the at least one other vehicle associated with the construction site completely overlap.

In some embodiments, a system for dispatch control of an autonomous construction vehicle includes a processor and a memory. The memory includes instructions that, when executed by the processor, cause the processor to: generate, for a construction site, a construction path for the autonomous construction vehicle and at least one other vehicle associated with the construction site; identify at least one possible collision zone in the construction path for at least the autonomous construction vehicle and the at least one other vehicle associated with the construction site; in response to identifying the at least one possible collision zone for at least the autonomous construction vehicle and the at least one other vehicle associated with the construction site: divide the construction path into one or more sections; determine all possible collision combinations between at least the autonomous construction vehicle and the at least one other vehicle associated with the construction site; and identify one or more collision zones associated with at least one of the one or more sections of the construction path based on the possible collision combinations; and selectively control, using data from one or more sensors associated with one or more of the autonomous construction vehicle and the at least one other vehicle associated with the construction site, at least the autonomous construction vehicle based on the possible collision zones.

In some embodiments, the at least one possible collision zone includes a possible collision zone that includes at least the autonomous construction vehicle and the at least one other vehicle associated with the construction site in the same section of the construction path. In some embodiments, the at least one possible collision zone includes a possible collision zone that includes at least the autonomous construction vehicle and the at least one other vehicle associated with the construction site in different sections of the construction path. In some embodiments, the instructions further cause the processor to determine all possible collision combinations between at least the autonomous construction vehicle and the at least one other vehicle associated with the construction site by: determining whether a first collision condition exists; in response to a determination that the first collision condition does not exist, determining whether a second collision condition exists; in response to a determination that the second collision condition does not exist, determining whether a third collision condition exists; in response to determining that none of the first collision condition, the second collision condition, and the third collision condition exist, determining that no possible collision combinations exist; and, in response to determining that at least one of the first collision condition the second collision condition, and the third collision condition exist, identifying possible collision combinations associated with the at least one of the at least one of the first collision condition the second collision condition, and the third collision condition. In some embodiments, the first collision condition includes a condition where at least the autonomous construction vehicle and the at least one other vehicle associated with the construction site overlap and intersect at least partially in a parallel direction. In some embodiments, the second collision condition includes a condition where at least the autonomous construction vehicle and the at least one other vehicle associated with the construction site intersect obliquely. In some embodiments, the third collision condition includes a condition where at least the autonomous construction vehicle and the at least one other vehicle associated with the construction site completely overlap.

In some embodiments, an apparatus for dispatch control of an autonomous construction vehicle includes a processor and a memory. The memory includes instructions that, when executed by the processor, cause the processor to: generate, for a construction site, a construction path for the autonomous construction vehicle and at least one other vehicle associated with the construction site; identify at least one possible collision zone in the construction path for at least the autonomous construction vehicle and the at least one other vehicle associated with the construction site; in response to identifying the at least one possible collision zone for at least the autonomous construction vehicle and the at least one other vehicle associated with the construction site: divide the construction path into one or more sections; determine whether a first collision condition exists; in response to a determination that the first collision condition does not exist, determine whether a second collision condition exists; in response to a determination that the second collision condition does not exist, determine whether a third collision condition exists; in response to determining that none of the first collision condition, the second collision condition, and the third collision condition exist, determine that no possible collision combinations exist; in response to determining that at least one of the first collision condition the second collision condition, and the third collision condition exist, identify all possible collision combinations between at least the autonomous construction vehicle and the at least one other vehicle associated with the construction site associated with the at least one of the at least one of the first collision condition the second collision condition, and the third collision condition; and identify one or more collision zones associated with at least one of the one or more sections of the construction path based on the possible collision combinations; and selectively control, using data from one or more sensors associated with one or more of the autonomous construction vehicle and the at least one other vehicle associated with the construction site, at least the autonomous construction vehicle based on the possible collision zones.

In some embodiments, the at least one possible collision zone includes a possible collision zone that includes at least the autonomous construction vehicle and the at least one other vehicle associated with the construction site in the same section of the construction path. In some embodiments, the at least one possible collision zone includes a possible collision zone that includes at least the autonomous construction vehicle and the at least one other vehicle associated with the construction site in different sections of the construction path. In some embodiments, the first collision condition includes a condition where at least the autonomous construction vehicle and the at least one other vehicle associated with the construction site overlap and intersect at least partially in a parallel direction. In some embodiments, the second collision condition includes a condition where at least the autonomous construction vehicle and the at least one other vehicle associated with the construction site intersect obliquely. In some embodiments, the third collision condition includes a condition where at least the autonomous construction vehicle and the at least one other vehicle associated with the construction site completely overlap.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between functional blocks) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A. The term subset does not necessarily require a proper subset. In other words, a first subset of a first set may be coextensive with (equal to) the first set.

In this application, including the definitions below, the term "controller" may be replaced with the term "circuit." The term "controller" may refer to, be part of, or include processor hardware (shared, dedicated, or group) that executes code and memory hardware (shared, dedicated, or group) that stores code executed by the processor hardware.

As used herein, the term controller can include a packaged functional hardware unit designed for use with other components, processing circuitry configured to perform a particular function, and a self-contained hardware or software component that interfaces with a larger system. For example, a controller can include an application specific integrated circuit (ASIC), a Field Programmable Gate Array (FPGA), a circuit, digital logic circuit, an analog circuit, a combination of discrete circuits, gates, and other types of hardware or combination thereof. In other embodiments, a controller can include memory that stores instructions executable by the controller or processor to implement a feature of the disclosed embodiments.

The controller may include one or more interface circuits. In some examples, the interface circuit(s) may implement wired or wireless interfaces that connect to a local area network (LAN) or a wireless personal area network (WPAN). Examples of a LAN are Institute of Electrical and Electronics Engineers (IEEE) Standard 802.11-2016 (also known as the WIFI wireless networking standard) and IEEE Standard 802.3-2015 (also known as the ETHERNET wired networking standard). Examples of a WPAN are the BLUETOOTH wireless networking standard from the Bluetooth Special Interest Group and IEEE Standard 802.15.4.

The controller may communicate with other controllers using the interface circuit(s). Although the controller may be depicted in the present disclosure as logically communicating directly with other controllers, in various implementations the controller may actually communicate via a communications system. The communications system includes physical and/or virtual networking equipment such as hubs, switches, routers, and gateways. In some implementations, the communications system connects to or traverses a wide area network (WAN) such as the Internet. For example, the communications system may include multiple LANs connected to each other over the Internet or point-to-point leased lines using technologies including Multiprotocol Label Switching (MPLS) and virtual private networks (VPNs).

In various implementations, the functionality of the controller may be distributed among multiple controllers that are connected via the communications system. For example, multiple controllers may implement the same functionality distributed by a load balancing system. In a further example, the functionality of the controller may be split between a server (also known as remote, or cloud) controller and a client (or, user) controller.

The term code, as used above, may include software, firmware, and/or microcode, and may refer to programs, routines, functions, classes, data structures, and/or objects. Shared processor hardware encompasses a single microprocessor that executes some or all code from multiple controllers. Group processor hardware encompasses a microprocessor that, in combination with additional microprocessors, executes some or all code from one or more controllers. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple controllers. Group memory hardware encompasses a memory device that, in combination with other memory devices, stores some or all code from one or more controllers.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

Implementations of the systems, algorithms, methods, instructions, etc., described herein may be realized in hardware, software, or any combination thereof. The hardware may include, for example, computers, intellectual property (IP) cores, application-specific integrated circuits (ASICs), programmable logic arrays, optical processors, programmable logic controllers, microcode, microcontrollers, servers, microprocessors, digital signal processors, or any other suitable circuit. In the claims, the term "processor" should be understood as encompassing any of the foregoing hardware, either singly or in combination. The terms "signal" and "data" are used interchangeably.

What is claimed is:

1. A method for dispatch control of an autonomous construction vehicle, the method comprising:

generating, for a construction site, a construction path for the autonomous construction vehicle and at least one other vehicle associated with the construction site;

identifying at least one possible collision zone in the construction path for at least the autonomous construction vehicle and the at least one other vehicle associated with the construction site;

in response to identifying the at least one possible collision zone for at least the autonomous construction vehicle and the at least one other vehicle associated with the construction site:

dividing the construction path into two or more sections;

determining all possible collision combinations between at least the autonomous construction vehicle and the at least one other vehicle associated with the construction site; and identifying one or more collision zones associated with at least one of the two or more sections of the construction path based on the possible collision combinations; and selectively controlling, using data from one or more sensors associated with one or more of the autonomous construction vehicle and the at least one other vehicle associated with the construction site, at least the autonomous construction vehicle based on the one or more collision zones.

2. The method of claim 1, wherein the at least one possible collision zone includes a possible collision zone that includes at least the autonomous construction vehicle and the at least one other vehicle associated with the construction site in the same section of the construction path.

3. The method of claim 1, wherein the at least one possible collision zone includes a possible collision zone that includes at least the autonomous construction vehicle and the at least one other vehicle associated with the construction site in different sections of the construction path.

4. The method of claim 1, wherein determining all possible collision combinations between at least the autonomous construction vehicle and the at least one other vehicle associated with the construction site includes:

determining whether a first collision condition exists;

in response to a determination that the first collision condition does not exist, determining whether a second collision condition exists;

in response to a determination that the second collision condition does not exist, determining whether a third collision condition exists;

in response to determining that none of the first collision condition, the second collision condition, and the third collision condition exist, determining that no possible collision combinations exist; and in response to determining that at least one of the first collision condition, the second collision condition, and the third collision condition exist, identifying possible collision combinations associated with the at least one of the first collision condition, the second collision condition, and the third collision condition.

5. The method of claim 4, wherein the first collision condition includes a condition where at least the autonomous construction vehicle and the at least one other vehicle associated with the construction site overlap and intersect at least partially in a parallel direction.

6. The method of claim 4, wherein the second collision condition includes a condition where at least the autonomous construction vehicle and the at least one other vehicle associated with the construction site intersect obliquely.

7. The method of claim 4, wherein the third collision condition includes a condition where at least the autonomous construction vehicle and the at least one other vehicle associated with the construction site completely overlap.

8. A system for dispatch control of an autonomous construction vehicle, the system comprising:

a processor; and a non-transitory memory including instructions that, when executed by the processor, cause the processor to:

generate, for a construction site, a construction path for the autonomous construction vehicle and at least one other vehicle associated with the construction site;

identify at least one possible collision zone in the construction path for at least the autonomous construction vehicle and the at least one other vehicle associated with the construction site;

in response to identifying the at least one possible collision zone for at least the autonomous construction vehicle and the at least one other vehicle associated with the construction site:

divide the construction path into two or more sections;

determine all possible collision combinations between at least the autonomous construction vehicle and the at least one other vehicle associated with the construction site; and identify one or more collision zones associated with at least one of the two or more sections of the construction path based on the possible collision combinations; and selectively control, using data from one or more sensors associated with one or more of the autonomous construction vehicle and the at least one other vehicle associated with the construction site, at least the autonomous construction vehicle based on the one or more collision zones.

9. The system of claim 8, wherein the at least one possible collision zone includes a possible collision zone that includes at least the autonomous construction vehicle and the at least one other vehicle associated with the construction site in the same section of the construction path.

10. The system of claim 8, wherein the at least one possible collision zone includes a possible collision zone that includes at least the autonomous construction vehicle and the at least one other vehicle associated with the construction site in different sections of the construction path.

11. The system of claim 8, wherein the instructions further cause the processor to determine all possible collision combinations between at least the autonomous construction vehicle and the at least one other vehicle associated with the construction site by:

determining whether a first collision condition exists;

in response to a determination that the first collision condition does not exist, determining whether a second collision condition exists;

in response to a determination that the second collision condition does not exist, determining whether a third collision condition exists;

in response to determining that none of the first collision condition, the second collision condition, and the third collision condition exist, determining that no possible collision combinations exist; and in response to determining that at least one of the first collision condition, the second collision condition, and the third collision condition exist, identifying possible collision combinations associated with the at least one of the first collision condition, the second collision condition, and the third collision condition.

12. The system of claim 11, wherein the first collision condition includes a condition where at least the autonomous construction vehicle and the at least one other vehicle associated with the construction site overlap and intersect at least partially in a parallel direction.

13. The system of claim 11, wherein the second collision condition includes a condition where at least the autonomous construction vehicle and the at least one other vehicle associated with the construction site intersect obliquely.

14. The system of claim 11, wherein the third collision condition includes a condition where at least the autonomous construction vehicle and the at least one other vehicle associated with the construction site completely overlap.

15. An apparatus for dispatch control of an autonomous construction vehicle, the apparatus comprising:

a processor; and a non-transitory memory including instructions that, when executed by the processor, cause the processor to:

generate, for a construction site, a construction path for the autonomous construction vehicle and at least one other vehicle associated with the construction site;

identify at least one possible collision zone in the construction path for at least the autonomous construction vehicle and the at least one other vehicle associated with the construction site;

in response to identifying the at least one possible collision zone for at least the autonomous construction vehicle and the at least one other vehicle associated with the construction site:

divide the construction path into two or more sections;

determine whether a first collision condition exists;

in response to a determination that the first collision condition does not exist, determine whether a second collision condition exists;

in response to a determination that the second collision condition does not exist, determine whether a third collision condition exists;

in response to determining that none of the first collision condition, the second collision condition, and the third collision condition exist, determine that no possible collision combinations exist;

in response to determining that at least one of the first collision condition, the second collision condition, and the third collision condition exist, identify all possible collision combinations between at least the autonomous construction vehicle and the at least one other vehicle associated with the construction site associated with the at least one of the first collision condition, the second collision condition, and the third collision condition; and identify one or more collision zones associated with at least one of the two or more sections of the construction path based on the possible collision combinations; and selectively control, using data from one or more sensors associated with one or more of the autonomous construction vehicle and the at least one other vehicle associated with the construction site, at least the autonomous construction vehicle based on the one or more collision zones.

16. The apparatus of claim 15, wherein the at least one possible collision zone includes a possible collision zone that includes at least the autonomous construction vehicle and the at least one other vehicle associated with the construction site in the same section of the construction path.

17. The apparatus of claim 15, wherein the at least one possible collision zone includes a possible collision zone that includes at least the autonomous construction vehicle and the at least one other vehicle associated with the construction site in different sections of the construction path.

18. The apparatus of claim 15, wherein the first collision condition includes a condition where at least the autonomous construction vehicle and the at least one other vehicle associated with the construction site overlap and intersect at least partially in a parallel direction.

19. The apparatus of claim 15, wherein the second collision condition includes a condition where at least the autonomous construction vehicle and the at least one other vehicle associated with the construction site intersect obliquely.

20. The apparatus of claim 15, wherein the third collision condition includes a condition where at least the autonomous construction vehicle and the at least one other vehicle associated with the construction site completely overlap.

* * * * *